US007997032B2

(12) United States Patent
Riley et al.

(10) Patent No.: US 7,997,032 B2
(45) Date of Patent: Aug. 16, 2011

(54) SNOW RETENTION MECHANISM

(75) Inventors: Matthew Riley, Idaho Falls, ID (US); Yancy Whipple, Ammon, ID (US)

(73) Assignee: Pioneer Metal, Inc. ID (US)

( * ) Notice: Subject to any disclaimer, the term of this patent is extended or adjusted under 35 U.S.C. 154(b) by 239 days.

(21) Appl. No.: 12/329,207

(22) Filed: Dec. 5, 2008

(65) Prior Publication Data

US 2009/0266003 A1 Oct. 29, 2009

Related U.S. Application Data

(60) Provisional application No. 61/012,043, filed on Dec. 6, 2007.

(51) Int. Cl.
*E04D 13/00* (2006.01)

(52) U.S. Cl. ..... 52/24; 52/26; 52/18; 52/57; 52/82

(58) Field of Classification Search ..... 52/18, 24, 52/25, 26, 57, 63, 82, 101, 198, 301, 745.2
See application file for complete search history.

(56) References Cited

U.S. PATENT DOCUMENTS

| | | | | |
|---|---|---|---|---|
| 193,809 | A | | 8/1877 | Dugan |
| 507,776 | A | | 10/1893 | Berger |
| 756,884 | A | | 4/1904 | Parry |
| 853,897 | A | | 5/1907 | Porter et al. |
| 884,850 | A | | 4/1908 | Peter |
| 933,784 | A | | 9/1909 | Peter |
| 939,516 | A | | 11/1909 | Laird |
| 1,016,463 | A | | 2/1912 | Wilkins |
| 1,330,309 | A | | 2/1920 | Dixon |
| 2,272,852 | A | | 2/1942 | Schaefer |
| D221,941 | S | | 9/1971 | Murphy |
| 4,270,721 | A | | 6/1981 | Mainor |
| 4,903,929 | A | | 2/1990 | Hoffman |
| 5,205,088 | A | | 4/1993 | Mueller |
| 5,228,248 | A | | 7/1993 | Haddock |
| 5,271,194 | A | | 12/1993 | Drew |
| 5,282,340 | A | | 2/1994 | Cline et al. |
| 5,483,772 | A | | 1/1996 | Haddock |
| 5,491,931 | A | | 2/1996 | Haddock |
| 5,522,185 | A | | 6/1996 | Cline |
| 5,557,903 | A | | 9/1996 | Haddock |
| 5,570,557 | A | | 11/1996 | Kwiatkowski et al. |
| 5,613,328 | A | * | 3/1997 | Alley ..... 52/25 |
| 5,664,374 | A | * | 9/1997 | Lee ..... 52/24 |
| 5,694,721 | A | | 12/1997 | Haddock |
| 5,715,640 | A | | 2/1998 | Haddock |
| 5,786,563 | A | | 7/1998 | Tiburzi |
| 5,901,507 | A | | 5/1999 | Smeja et al. |
| 5,983,588 | A | | 11/1999 | Haddock |
| 6,141,917 | A | | 11/2000 | Mueller |
| 6,164,033 | A | | 12/2000 | Haddock |
| 6,470,629 | B1 | | 10/2002 | Haddock |

(Continued)

FOREIGN PATENT DOCUMENTS

| | | |
|---|---|---|
| DE | 2126082 | 12/1972 |

(Continued)

*Primary Examiner* — Brian E Glessner
*Assistant Examiner* — Patrick Maestri
(74) *Attorney, Agent, or Firm* — Bateman IP Law Group

(57) ABSTRACT

A snow guard and snow guard cover are provided which allow the cover to be attached to the snow guard to conceal the snow guard from view. The cover allows the snow guard to better match the finish of the roof, and protects the snow guard from sunlight.

19 Claims, 7 Drawing Sheets

U.S. PATENT DOCUMENTS

| | | | | |
|---|---|---|---|---|
| 6,499,259 | B1 | 12/2002 | Hockman | |
| 6,526,701 | B2 * | 3/2003 | Stearns et al. | 52/24 |
| 6,536,729 | B1 | 3/2003 | Haddock | |
| 6,718,718 | B2 | 4/2004 | Haddock | |
| 6,922,948 | B2 | 8/2005 | Smeja et al. | |
| 7,013,612 | B2 | 3/2006 | Haddock | |
| 7,100,338 | B2 | 9/2006 | Haddock | |
| 7,127,867 | B2 | 10/2006 | Smeja et al. | |
| 7,174,677 | B1 | 2/2007 | Dressler | |
| 2002/0088196 | A1 | 7/2002 | Haddock | |
| 2005/0217203 | A1 | 10/2005 | Haddock | |
| 2006/0010786 | A1 | 1/2006 | Rogers | |
| 2007/0245636 | A1 | 10/2007 | Ayer et al. | |

FOREIGN PATENT DOCUMENTS

| | | |
|---|---|---|
| DE | 2523087 | 11/1976 |
| DE | 2845103 | 4/1980 |
| DE | 2845104 | 4/1980 |
| DE | 3716491 | 12/1988 |
| DE | 3723020 | 1/1989 |

* cited by examiner

SNOW RETENTION MECHANISM

RELATED APPLICATIONS

The present application claims the benefit of U.S. Provisional Application Ser. No. 61/012,043, filed Dec. 6, 2007, which is expressly incorporated herein by reference.

BACKGROUND OF THE INVENTION

1. The Field of the Invention

The present invention relates to a method for concealing snow retention members on a roof. More particularly, the present invention provides a mechanism for improving the aesthetic look of snow retention members or snow guards and minimizing the visibility of undesirable structures on the roof, and for providing a cover to slow down the deterioration process of the plastic snow retention device.

2. State of the Art

Retaining of snow mass is a problem encountered by many types of roofs in climates which receive considerable amounts of snow. On metal and other types of roofs, large masses of snow can break free of the roof and slide off onto individuals standing next to a building, or on plants around the building. The weight of snow sliding off the roof can be several thousand pounds and can potentially injure an individual standing adjacent to the roof. Additionally, it can break tree limbs, damage other types of plants and even damage landscape lighting, vehicles, gutters, skylights, etc.

For this reason, many roofs which are prone to sliding snow have snow retention members disposed thereon. The snow retention members are designed to prevent a large mass of snow from sliding off the roof at a given time. Rather, the snow is held in place and allowed to melt or slide off in much smaller masses.

There are currently numerous different types of retaining members or snow guards for preventing snow slides. One commonly used type of snow guard is made from bent or cast pieces of metal which are configured to retain the snow while being aesthetically pleasing. Most of such presently available devices, however, lack the structural rigidity to withstand thousands of pounds of snow, or are too small to catch a sufficient amount of snow to be effective, while maintaining an aesthetically pleasing design. Thus, it is not uncommon for them to be damaged by the snow. Furthermore, metal snow guards which are larger and stronger, or which are decoratively formed to be more aesthetically pleasing tend to be fairly expensive. Due to the large number of snow guards which are necessary on a typical roof, the cost of installing these metal snow guards can be quite high. Even the available decorative metal snow guards, however, typically do not match the roofing materials well and may not be visually appealing.

An alternate method for controlling the snow includes the attachment of pieces of plastic to the roof. The pieces of plastic, typically polycarbonates, are attached to the roof and made sufficiently thick to withstand the weight of the snow. However, plastic generally does not look good when attached to the roof of a house or office building. Some have attempted to match the color of the plastic to the color of the roof. However, it is very difficult to get the color of a plastic to match the colors of roofs made out of different materials such as metal, wood, etc. Additionally, the plastics tend to discolor over time and thus look even less like the coloring of the roof. Thus, while presenting a reduction in cost over their metal counterparts, the plastic snow guards tend to be less visually appealing and often result in a less than desirable appearance when installed.

While some companies have formed snow retention members from clear plastics/polycarbonates in an attempt to make them less visually intrusive, these still present problems. While the clear polycarbonate is generally less noticeable than other plastics, it can still be easily observed and does not match the existing roof well. Additionally, over time the ultraviolet radiation of the sun causes plastics to yellow and become brittle, making the snow guards less appealing visually and reducing the strength of the snow guards. Additionally, even the clear plastics/polycarbonates are noticeable on the roof and do not provide an aesthetically pleasing design.

Additionally, available snow guards often lack the structural strength necessary to retain large quantities of snow, or do not grip the snow well, reducing the reliability of the device and increasing the risk that the snow might fall off of the roof and cause damage. Thus, there is a need to provide a more aesthetically pleasing design which will adequately hold the weight of the snow on the roof.

SUMMARY OF THE INVENTION

An object of the present invention is to provide a more aesthetically pleasing means for retaining snow on a roof.

In accordance with the above and other objects of the invention, a snow guard and associated snow guard cover are provided. The snow guard cover is formed from a piece of material which matches the aesthetics of the roof, such as metal, wood, asphalt, tile, slate (clay or concrete) fiberglass, PVC, etc. Common metals may include steel, aluminum, copper, zinc, "galvalume", brass, nickel, lead, tin, etc.

The cover is configured so as to cover a retention member or snow guard which is otherwise visible from persons on the ground so as to provide a more aesthetically pleasing look which matches the roof material. Unlike conventional metal retaining members, however, the devices can be used with inexpensive polycarbonate/plastic snow guards, thereby saving costs, while providing an aesthetically pleasing look that blends better with the look of the roof.

The cover can be attached to the snow guard in a variety of ways. These include adhesives (such as acrylics, urethanes, contact cements, UV curables, emulsion, sealants, anaerobics, cyanoacylates, toughened acrylics, polyurethanes, silicones, phenolics, polyimides, hot melts, plastisols, polyvinyl acetate, pressure sensitive adhesives, epoxies, double sided tape, etc.), magnets, rivets, screws, clip on systems, a tab system in which pushing tabs from the cover through holes in the base piece and bending them to keep the cover on, panel-type fasteners such as push in or arrow clips, barbed fasteners, retaining rings, lock washers, tooth locks and snap-in or slide-in systems using grooves or a guide system built into the plastic mold.

These and other aspects of the present invention are realized in a snow guard and decorative cover as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Several aspects from different figures may be used in accordance with the present invention in a single structure. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1A:
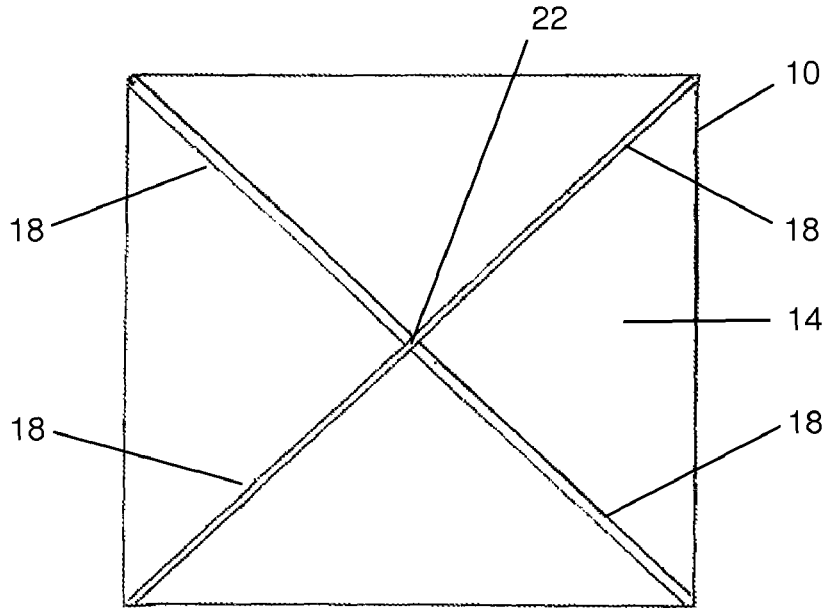
FIG. 1A (Prior Art)
FIG. 1A shows a perspective view of a snow retention mechanism or snow guard formed in accordance with the prior art.
Figure 1B:
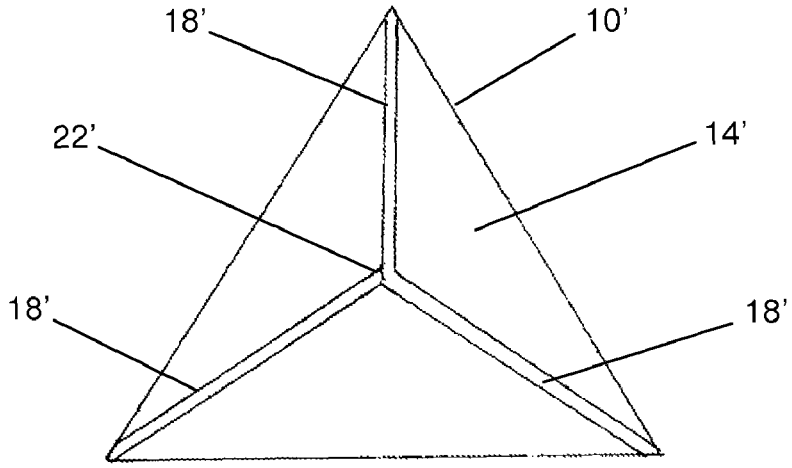
FIG. 1B (Prior Art)
FIG. 1B shows a top view of an alternate configuration of a snow guard in accordance with the prior art.

Turning to FIGS. 1A and 1B, there are shown top views of snow guards made in accordance with the principles of the prior art. The snow guards 10 and 10' each include a base 14 and 14' which is configured for attachment to a roof, such as a metal roof. Typically, the base 14 and 14' is adhesively attached to the roof. A plurality of walls 18 and 18' extend upwardly from the corners of the base 14 and 14' and meet a central vertical axis 22 and 22' of the base.

One disadvantage of such devices is that many do not care for the look of having a piece of plastic (polycarbonate, etc.) being glued to a metal roof. While attempts have been made to form the snow guard in colors to match the roof, it is often difficult to get a true match between a color of plastic and a color of metal or other roofing material. Additionally, many plastics tend to yellow with exposure to ultraviolet radiation and the color is soon not what is desired. Additionally, the snow guard weakens from the UV exposure and is more likely to break under the weight of the snow. While plastic snow guards may be effective at stopping snow, there is a desire to have snow guards which more closely match the color and material of the roof. While metal snow guards have been made which generally look better than plastic guards, these may not always match the roof and may not have sufficient integrity to withstand the weight of the snow, or may be smaller than is desired to be effective in holding the snow.

Thus, in accordance with the present invention, it has been found that an improvement can be made by forming a plastic (polycarbonate, etc.) snow guard and covering it with a metal covering which matches or complements the color and/or material of the roof. Thus, for example, on a roof made of copper, a plastic snow guard is attached to the roof. Either prior to or after attachment of the snow guard to the roof, a cover is placed over the snow guard to complement the color of the roof. Thus, for example, a copper cover is used on the snow guard, concealing the snow guard from view, without interfering with the functional use of the snow guard.

Figure 2:
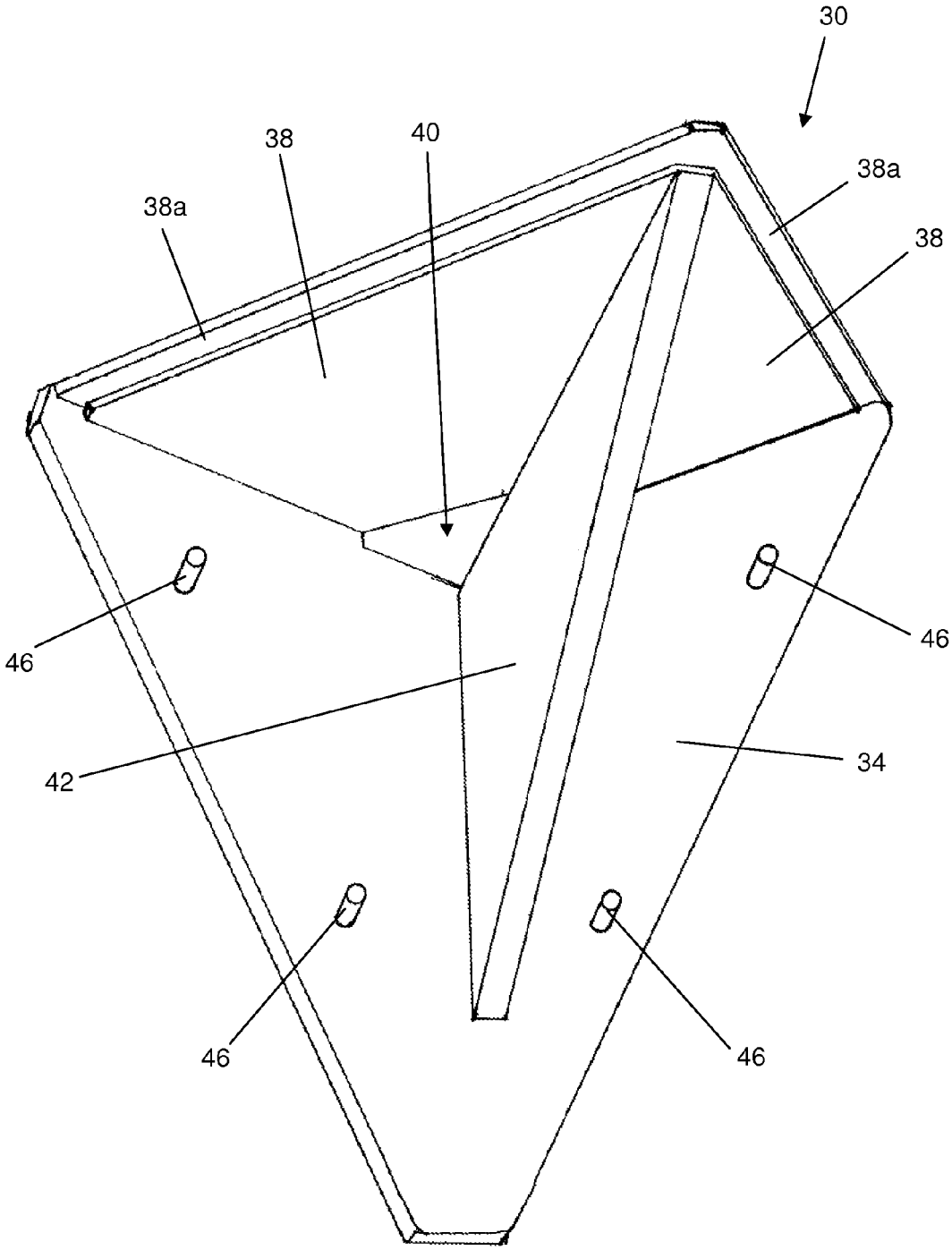
FIG. 2 shows a snow guard in accordance with an embodiment of the present invention.

Turning now to FIG. 2, there is shown a perspective view of a snow guard 30, made in accordance with the principles of the present invention. The snow guard 30 includes a base 34 which is configured for mounting to a roof by adhesive attachment or some other attachment mechanism. A pair of walls 38 are disposed at a slight angle to one another to provide a snow engagement surface. A small shoulder 38*a* is formed in the walls 38 to aid in positioning a decorative cover, as is detailed in FIG. 6. A small opening 40 is formed in the walls 38 to allow melted snow to pass through the snow guard 30.

Extending rearwardly from the walls 38 is a support wall 42. The support wall 42 extends rearwardly to provide support for the walls and enable the walls to hold a substantial amount of weight. Thus, it is preferred that the support wall 42 extends a greater distance than the two walls 38. Additionally, the three walls 38 and 42 meet toward the front end of the base 34, rather than at the central vertical axis, as is done in the prior art.

Disposed on the base 34 is a plurality of fastener means 46. As shown in FIG. 2, the fastener means 46 comprise a plurality of posts which may be barbed or otherwise contoured to allow attachment of the cover. As is shown, the cover is preferably attached to the snow guard 30 by pressing the cover onto the posts 46 such that the cover engages the posts. If desired, fastener means 46 can also be disposed on the walls 38 and the support wall 42.

Figure 3:
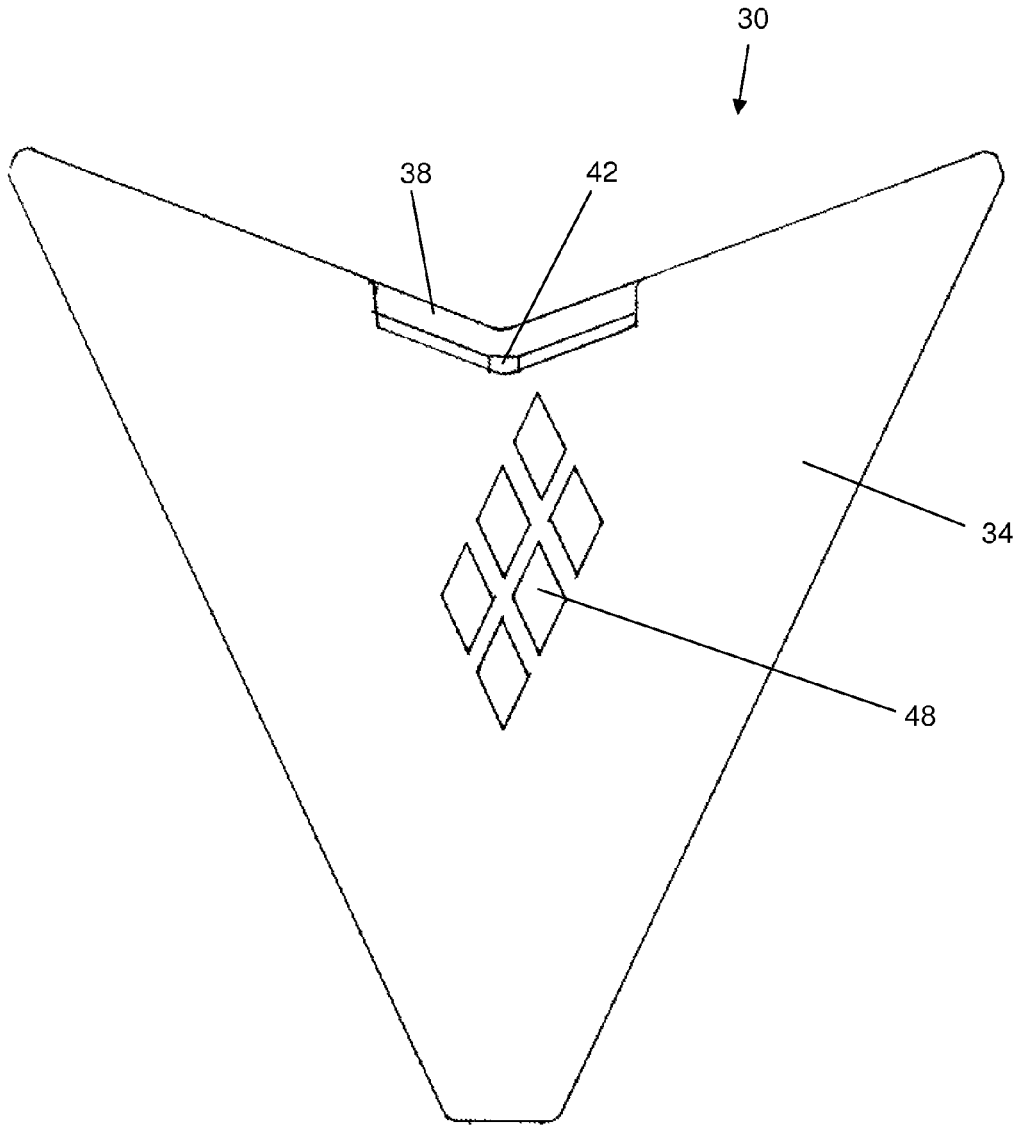
FIG. 3 shows the snow guard of FIG. 2.

Turning now to FIG. 3, a bottom view of the snow guard 30 is shown. As is illustrated, the base 34 has a plurality of recesses 48 formed therein. The recesses, while shown as covering a small part of the base for clarity, typically extend across a majority of the surface of the base. The recesses 48 receive glue when mounting the snow guard 30 to a roof and improve the adhesion of the snow guard to the roof.

Figure 4:
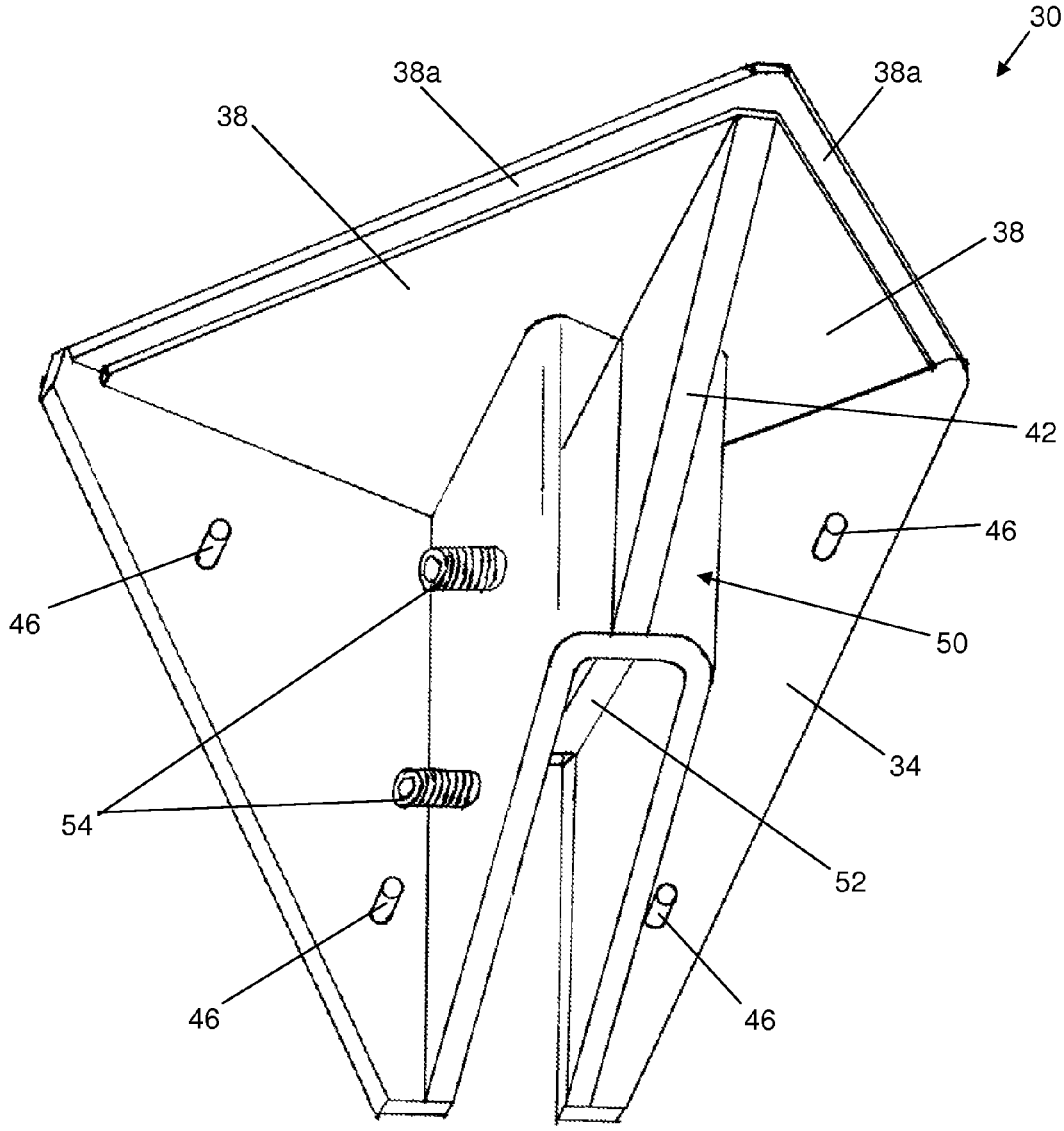
FIG. 4 shows an alternate embodiment of a snow guard made in accordance with the principles of the present invention.

Turning now to FIG. 4, a perspective view of another embodiment of the snow guard 30 is shown. The snow guard includes a base 34, walls 38 and shoulder 38*a*, support wall 42, and engagement posts 46. Differing from the embodiment of FIG. 2, the snow guard 30 has a channel 50 formed through the base 34 and walls 38, 42. The channel engages a raised ridge of a roof and is used to attach the snow guard to the roof. The channel 50 includes projections 52 and set screws 54 to grip a raised ridge on a roof.

Figure 5:
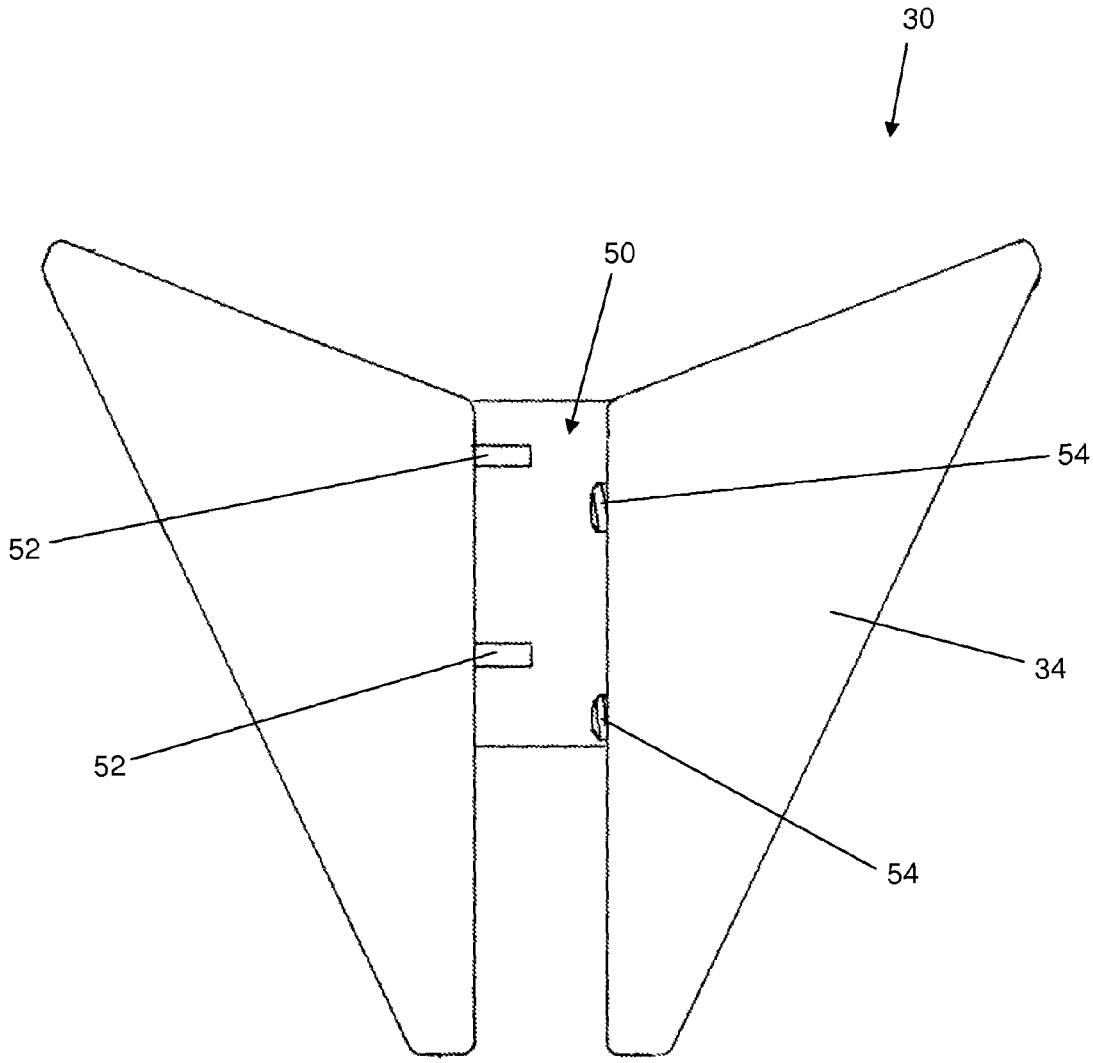
FIG. 5 shows the snow guard of FIG. 3.

Turning now to FIG. 5, a bottom view of the snow guard 30 of FIG. 4 is shown. It can be better seen how the channel 50 includes projections 52 and set screws 54 to grip a roof ridge. As the set screws 54 are tightened, the roof ridge is pinched between the projections 52 and the set screws 54, securing the snow guard 30.

Figure 6:
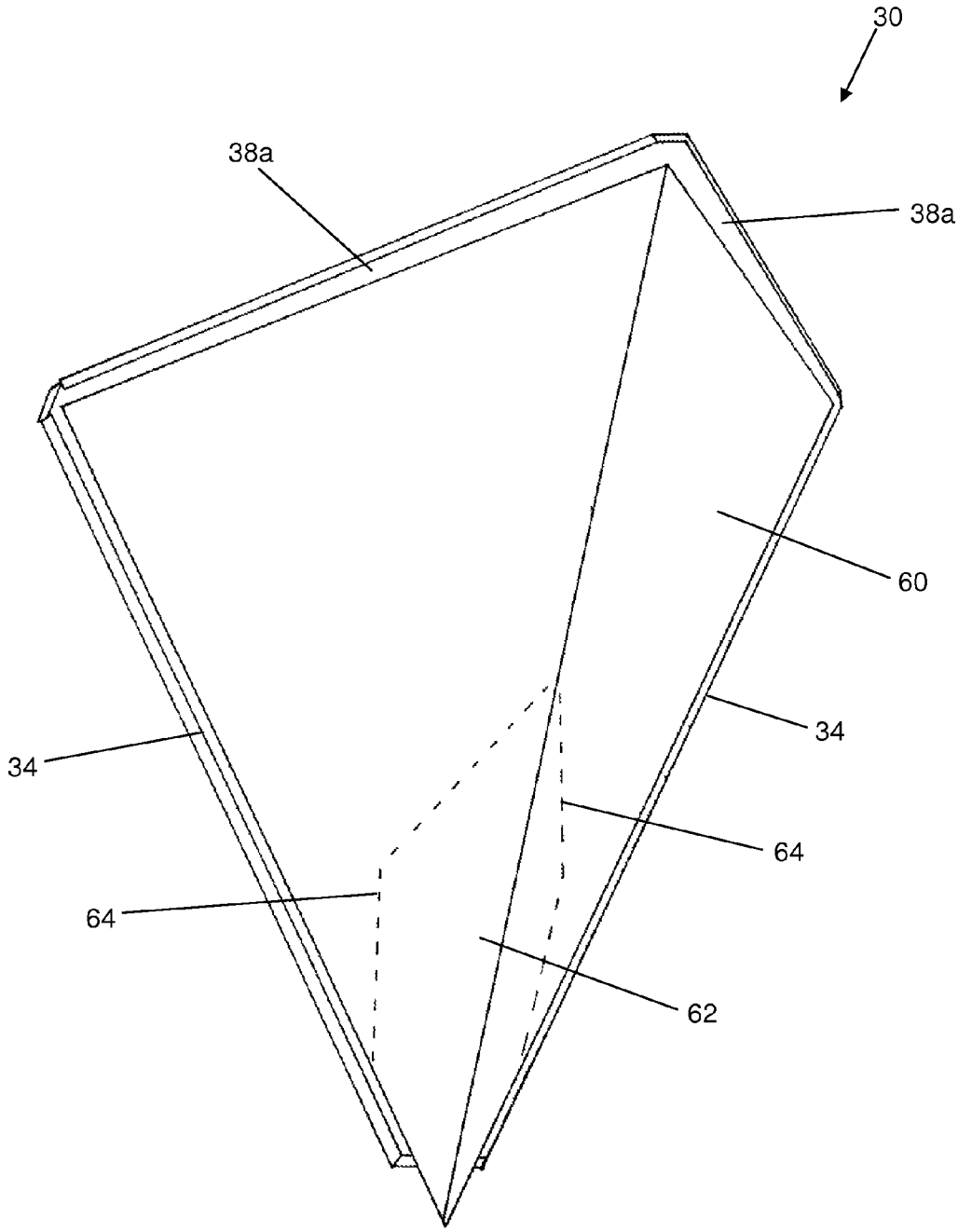
FIG. 6 shows a top view of a snow guard cover mounted to a snow guard in accordance with the principles of the present invention.

Turning now to FIG. 6, a perspective view of a snow guard 30 having a cover 60 attached thereto is shown. The cover 60 is typically made from bent sheet metal, and is preferably made of the same material as the roof, or a material which complements the material on the roof to which the snow guard is being attached. Thus, for example, if being placed on a copper roof, the cover 60 would be made from copper. The cover 60 may even be formed from cut pieces of excess roofing material. Likewise, the cover can be formed from pieces of material painted the same or a complementary color to the color of a roof. The cover 60 may include a cut out portion indicated by the area 62 enclosed by dashed line 64. The cut out portion 62 allows the cover to be used with the snow guard 30 of FIG. 4 without interfering with the roof ridge to which the snow guard 30 is attached. Thus, depending on the type of snow guard 30 being used, the cover 60 may be formed with or without the cut out 62.

Figure 7:
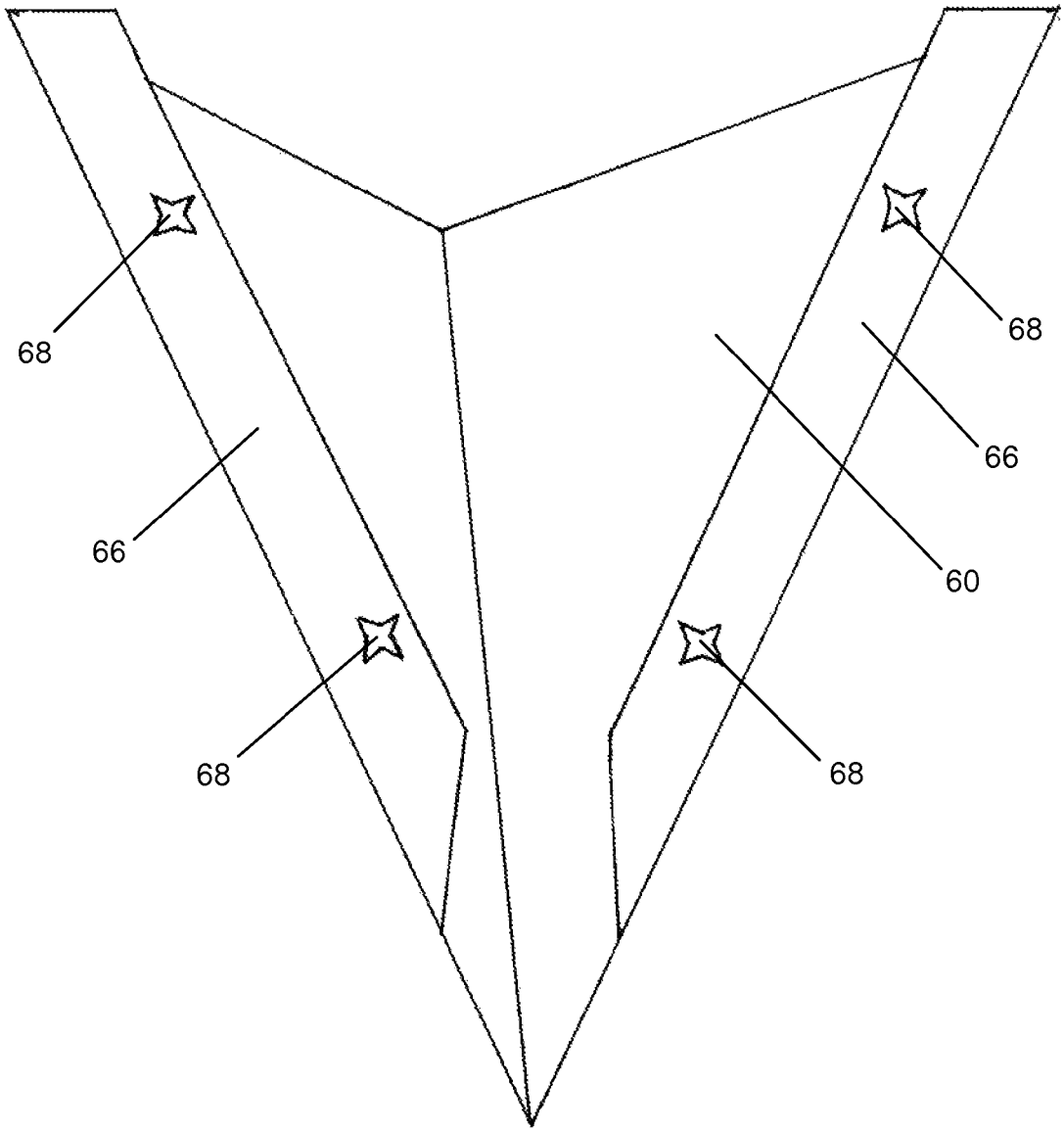
FIG. 7 shows a bottom view of the snow guard of FIG. 6.

Turning now to FIG. 7, a bottom perspective view of the cover 60 is shown. The cover 60 includes tabs 66 with star shaped holes 68 formed therein. The holes 68 are aligned with the posts 46 on the snow guards 30 and engage the posts when the guard 60 is attached to the snow guard 30. The interior points of the holes 68 engage the posts 46 on the base 34 of the snow guard 30 when the cover 60 is attached to the snow guard and allow the posts 46 to advance into the holes fairly easily, but make it substantially more difficult to pull the posts 46 out of the holes.

It will be appreciated that other means may be used to secure the cover 60 to the snow guard 30. For example, tabs may be disposed on the cover 60 so as to engage the walls 38 on the snow guard 30. Other fasteners such as magnets or even screws may be used to hold the cover in place. Alternatively, the base 34 or walls 38 may include a plurality of slots which extend into the same and receive tabs formed on a cover 60 which is to be attached to the snow guard and held in place. The fastener means 46 and 68 hold the cover 60 securely to the snow guard 30 and conceal the show guard from view. Thus, the cover 60 allows for the use of a very durable snow guard 30 while maintaining a consistent coloring along the roof of the house, making the snow guard difficult to see and less visually intruding.

It will be appreciated that the snow guard cover 60 can be readily made from a stamped piece of metal or other types of material such as those mentioned above. The cover 60 also may be custom formed depending on the desired look. Additionally, adhesive may be used if desired to further strengthen the holding of the cover to the snow guard.

The cover 60 provides a number of benefits. The cover 60 can be conveniently attached to a snow guard 30 to cover the snow guard with a material which either matches or complements a roof. This makes it significantly easier to make the snow guard attractive and not detract from the architecture of the roof and building. As the cover 60 may be formed from metal roofing material, the cover can be made with the same material and finish as the overall roof, allowing the cover to weather and age in the same manner as the roof. Additionally, the cover 60 is beneficial as it shields the snow guard 30 from sunlight. As has been discussed, the UV light present in sunlight causes many plastics, including polycarbonate, to become brittle. This embrittlement of the plastic reduces the strength of the plastic and may lead to the failure of the snow guard 30. Thus, the cover 60 improves the life and reliability of the snow guard 30.

There is thus disclosed an improved snow retention mechanism and cover. It will be appreciated that numerous changes may be made to the present invention without departing from the scope of the claims.

What is claimed is:

1. A device for holding snow on a roof, the mechanism comprising:

a snow guard configured for attachment to a roof, the snow guard having a wall extending upwardly and configured for preventing snow from sliding off of a roof;

a cover configured for attachment to the snow guard so as to cover the snow guard; and fasteners for holding the cover to the snow guard; and wherein the fasteners comprises a plurality of posts formed on the snow guard and a plurality of corresponding openings formed in the cover, the openings being configured to grip the posts.

2. The device according to claim 1, wherein the snow guard comprises a base and walls extending upwardly from the base, and wherein the cover extends over the walls and has edges disposed along the edges of the base.

3. A device for holding snow on a roof, the mechanism comprising:

a snow guard configured for attachment to a roof, the snow guard having a wall extending upwardly and configured for preventing snow from sliding off of a roof;

a cover configured for attachment to the snow guard so as to cover the snow guard; and fasteners for holding the cover to the snow guard; and wherein the snow guard comprises a generally triangular shaped base and three walls extending from a common point.

4. The device according to claim 1, wherein the snow guard comprises:

a generally planar base configured for placement against a roof;

a channel formed through the base, the channel being configured for receiving a ridge formed on the roof;

a fastener extending into the channel, the fastener being extendable into the channel so as to engage the ridge formed on the roof; and a wall extending upwardly from the base to prevent snow from sliding down a roof.

5. The device according to claim 1, wherein the cover is generally pyramid shaped.

6. The device according to claim 1, wherein the cover is formed from metal sheet.

7. The device according to claim 1, wherein the snow guard has a base and said wall extends upwardly from the base, and wherein the cover extends along the edge of said wall and along the edge of the base disposed behind said wall.

8. The device according to claim 1, wherein the snow guard comprises a base having a plurality of recesses formed in the lower surface thereof.

9. The device according to claim 3, wherein the snow guard comprises a plurality of posts extending upwardly from the base and wherein the cover engages said posts to secure the cover to the snow guard.

10. A snow guard comprising:

a base configured for attachment to a roof;

at least one wall disposed generally vertically for retaining snow;

at least one support wall generally perpendicular to the at least one wall; and fastener means formed on the snow guard, the fastener means configured to receive a metallic cover;

a cover; and wherein the snow guard comprises a plurality of posts extending upwardly from the base and wherein the cover engages said posts to secure the cover to the snow guard.

11. The snow guard of claim 10, wherein the cover is formed from sheet metal and is shaped so as to cover the snow guard.

12. The snow guard of claim 10, further comprising a channel formed through the base, the channel being configured for receiving a raised ridge formed on a roof, the channel having fasteners for engaging the ridge so as to secure the snow guard to the ridge.

13. The snow guard of claim 10, wherein the cover is formed from sheet metal and is generally a pyramid shape.

14. The snow guard of claim 10, wherein the cover is formed from the same material as the exposed surface of the roof.

15. The snow guard of claim 10, wherein the cover is the same color as the roof.

16. The snow guard of claim 1, wherein the cover is formed from the same material as the exposed surface of the roof.

17. The snow guard of claim 1, wherein the cover is the same color as the roof.

18. The snow guard of claim 3, wherein the cover is formed from the same material as the exposed surface of the roof.

19. The snow guard of claim 3, wherein the cover is the same color as the roof.

* * * * *